United States Patent [19]

Kitabayashi

[11] 4,325,692

[45] Apr. 20, 1982

[54] THROWAWAY TYPE GAS LIGHTER

[76] Inventor: Seiichi Kitabayashi, No. 919-12, Oaza Koshikiya, Ageo-shi, Saitama, Japan

[21] Appl. No.: 55,954

[22] Filed: Jul. 9, 1979

[51] Int. Cl.[3] ..... F23Q 1/02; F17C 13/00

[52] U.S. Cl. ..... 431/254; 431/277; 431/344; 222/402.22; 251/349

[58] Field of Search ..... 431/130, 131, 150, 151, 431/143, 254, 273, 276, 277, 344, 253, 343; 222/402.21, 402.22; 251/349, 352, 354, 353

[56] References Cited

U.S. PATENT DOCUMENTS

| | | | |
|---|---|---|---|
| 2,849,163 | 8/1958 | Soffer et al. | 222/402.22 |
| 3,148,522 | 9/1964 | Court | 431/344 |
| 3,270,925 | 9/1966 | Obst | 222/402.21 |
| 3,484,178 | 12/1969 | Weissmann | 431/343 |
| 3,533,718 | 10/1970 | Shuto | 431/277 |
| 3,650,660 | 3/1972 | Huguet | 431/277 |
| 3,784,352 | 1/1974 | Court | 431/277 |
| 3,854,862 | 12/1974 | Webster | 431/344 |

FOREIGN PATENT DOCUMENTS

| | | | |
|---|---|---|---|
| 1095033 | 12/1960 | Fed. Rep. of Germany | 431/253 |

*Primary Examiner*—Samuel Scott
*Assistant Examiner*—Lee E. Barnett
*Attorney, Agent, or Firm*—Fulwider, Patton, Rieber, Lee & Utecht

[57] ABSTRACT

A throwaway type gas lighter is disclosed which comprises a windbreak, a fuel tank filled with a liquefied fuel gas, a spark generating mechanism including a rasp wheel and a spring-biased flint, fuel supplying means including a fuel injection pipe for supplying the fuel gas from the fuel tank, an outer valve member made of elastic resilient material and sealingly surrounding the fuel injection pipe for selectively preventing the fuel gas from flowing and allowing the same to flow therethrough when the outer valve member is suitably deformed, and fuel supply adjusting means for adjusting the fuel flow rate in the fuel injection pipe whereby when the outer valve member is actuated and the rasp wheel is rotated, the ignition is completed.

6 Claims, 16 Drawing Figures

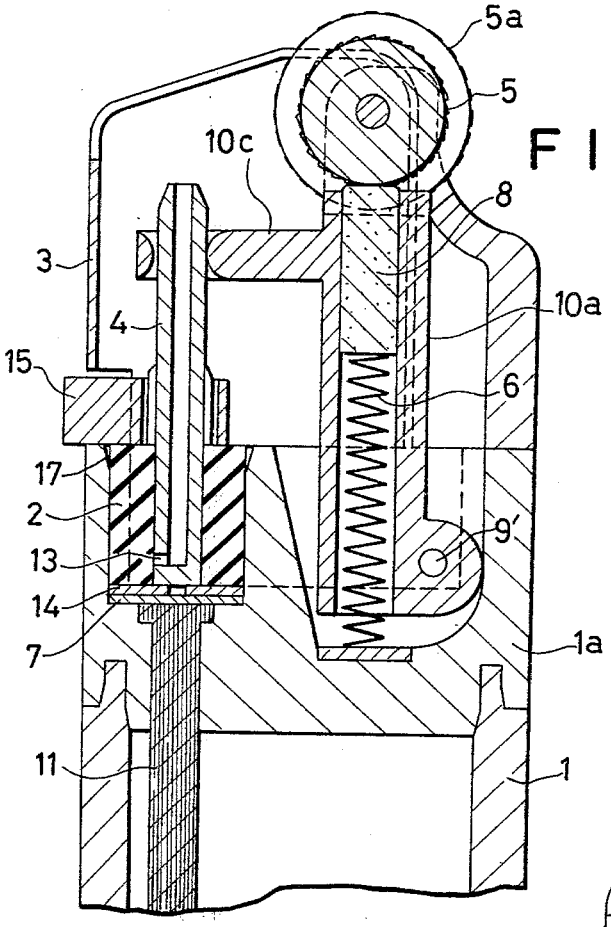
FIG. 6
FIG. 7
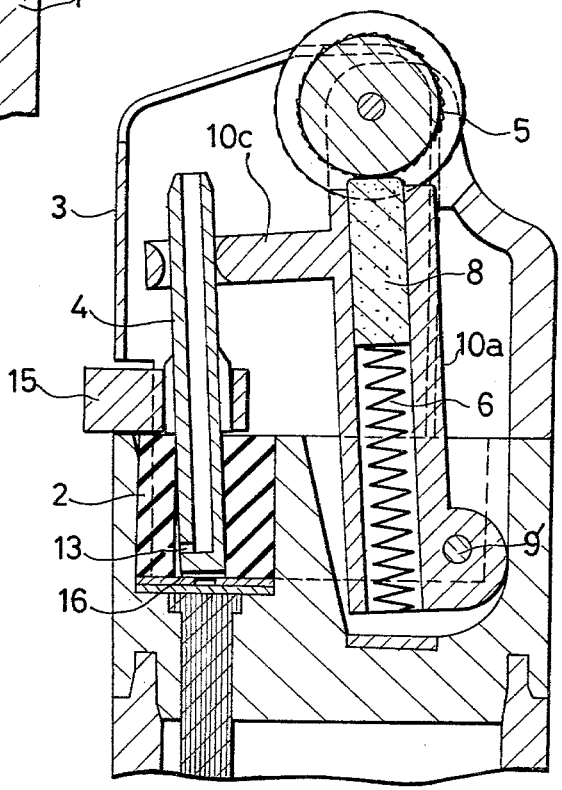

THROWAWAY TYPE GAS LIGHTER

BACKGROUND OF THE INVENTION

This invention relates to a throwaway type gas lighter use only once and then thrown away, more particularly to a novel valve mechanism for such a type of a gas lighter.

In such a gas lighter, it is especially desired that the manufacturing cost is low and a construction is simple. Typically, a gas lighter having a seesaw type valve actuating mechanism has been provided. However, such a prior art throwaway type gas lighter requires various mechanical parts because the seesaw type valve actuating mechanism is very complicated for a throwaway type gas lighter. A design of a prior art gas lighter is unduly limited due to usage of the seesaw type valve mechanism which is rather large in size in particular in its longitudinal direction. Also, for this designing limitation, a shape of a fuel tank is limited to a rectangular receptable. Further, in the prior art lighter, the fuel is accidentally leaked through a valve mechanism in a user's pocket. This is very dangerous.

SUMMARY OF THE INVENTION

In view of the above-noted defects, an object of the present invention is to provide a throwaway type gas lighter which is very simple in construction.

Another object of the present invention is to provide a throwaway type gas lighter a configuration of which is freely designed due to a usage of a simple and compact valve mechanism.

Another object of the present invention is to provide a throwaway type gas lighter suitable for a mass-production at low cost.

Still another object of the present invention is to provide a throwaway type gas lighter having a novel fuel flow adjusting means and an accidental fuel supply preventing mechanism.

The foregoing and other objects are achieved by providing a throwaway type gas lighter having a windbreak, a fuel tank, a spark generating mechanism, fuel supplying means including a fuel injection pipe, a novel outer valve member made of rubber or the like and sealingly surrounding the fuel injection pipe, and novel fuel supply adjusting means.

BRIEF DESCRIPTION OF THE DRAWINGS

In the accompanying drawings:

FIG. 6 is a cross sectional view showing a primary part of a second embodiment of the gas lighter according to the present invention;

FIG. 7 is a cross sectional view showing another state of the gas lighter shown in FIG. 6;

DETAILED DESCRIPTION OF THE PREFERRED EMBODIMENTS

Figure 1:
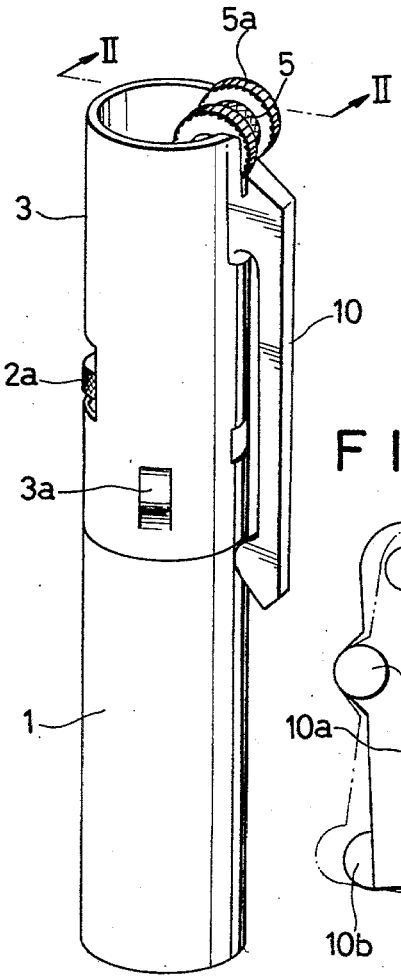
FIG. 1 is a perspective view showing a first embodiment of a throwaway type gas lighter according to the present invention.
Figure 2:
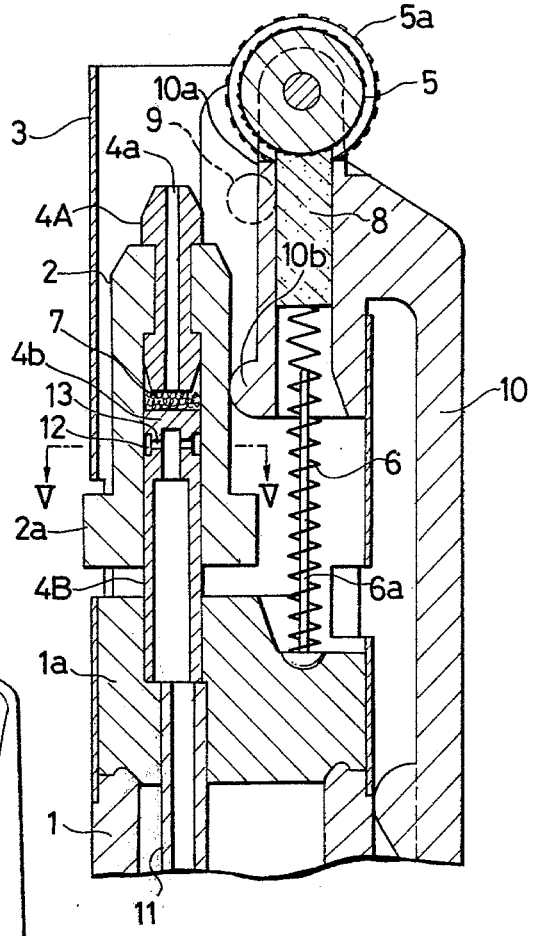
FIG. 2 is an enlarged cross sectional view showing a primary part of the gas lighter shown in FIG. 1.
Figure 3:
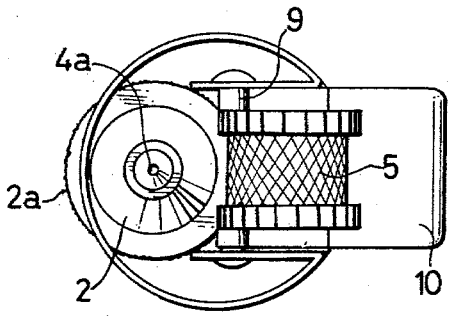
FIG. 3 is a top view of the gas lighter shown in FIG. 1.

A first embodiment according to the present invention will be hereinafter described in reference to FIGS. 1 and 2. FIG. 1 is a perspective view of a simple lighter using a liquefied gas such as butane, consisting of a fuel tank 1, a windbreak 3, a rasp wheel 5, a finger friction wheel 5*a* and an operational rod or clip 10. In FIG. 2, the windbreak 3 is secured to the fuel tank 1 by a pair of cut portions 3*a* formed on a cylindrical surface of the windbreak 3. Fuel injection pipes 4A and 4B communicable to the fuel tank 1 through a fuel supply pipe 11 are provided in the windbreak 3. The lower pipe 4B is fixedly implanted in a disc member 1*a*. The upper end portion 4*b* of such lower pipe 4*b* is closed. A vertical sleeve portion 10*a* of a clip 10 may be carried rotatably from the windbreak 3 by means of a transverse clip support rod 9 and is formed on its lower free extremity with a laterally inwardly projecting cam. A vertical flint 8 is inserted into the sleeve portion 10*a* of the clip 10 made of plastics or the like and serves to generate a spark cooperating with the rasp wheel 5 which is rotated together with a finger friction wheel 5*a*. The finger friction wheel may be dispensed with so that the rasp wheel is rotated directly by the user's finger. The flint 8 is always urged upward by a coil compression spring 6 which is supported by an arial spring support rod 6*a*. As shown in FIG. 3, the transverse clip support rod 9 is secured on its opposite ends to a pair of inwardly bent portions of the windbreak. An outer valve member 2 which is made of elastic resilient material such as rubber sealingly surrounds the fuel injection pipes 4A and 4B. A clip carriage is formed with an abutting portion 10*b* formed at a lower end of the sleeve portion 10*a* to pressingly abut to a suitable portion of the outer valve member 2 when an intermediate portion of the clip 10 is pressed to the lighter body as shown in FIG. 4.

A porous material 7 is inserted between the upper and lower fuel injection pipes 4A and 4B in the outer valve member 2. A fuel gas always rises to an annular groove 12 through a lateral hole 13 but the fuel gas is normally prevented from rising by an upper portion 4*b* of the lower pipe 4B. A fuel flow rate is adjustable according to the degree of compression of the porous material 7. The compression degree of the porous material is variable according to a distance between the upper and lower fuel injection pipes 4A and 4B. The distance between the pipes 4A and 4B is varied by moving a flanged portion 2*a* of the outer valve member up and down.

Figure 4:
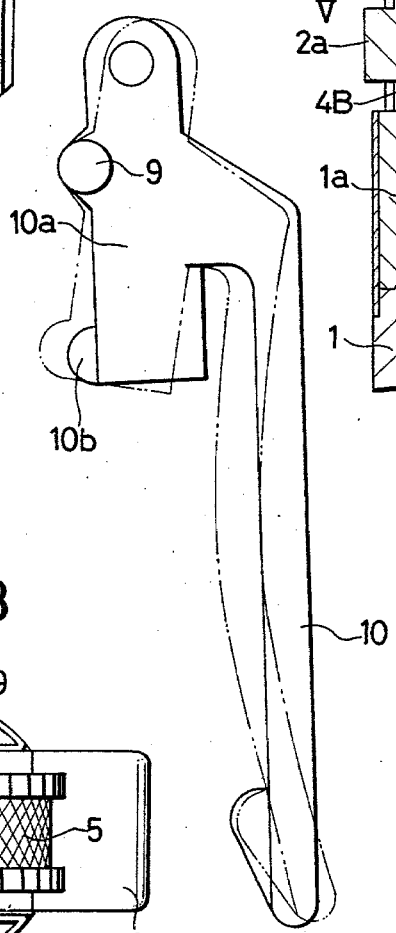
FIG. 4 is an explanatory view of a clip assembly of the gas lighter shown in FIG. 1.
Figure 5:
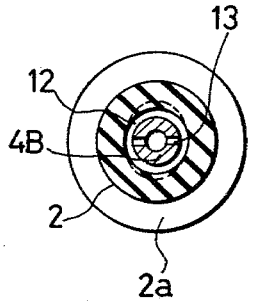
FIG. 5 is a cross sectional view taken along a line V—V in FIG. 2.

In operation, when the intermediate portion of the clip 10 is, as shown in FIG. 4, pressed toward the lighter body, the projected portion 10*b* pressingly abuts to the outer valve member 2 to thereby deform the outer valve member 2 as indicated by dotted line in FIG. 5, so that a fuel can flow through the upper portion 4*b* of the lower pipe 4B and the porous material 7 to an injection tip of the upper pipe 4A. Then, the rasp wheel is rotated by the user's thumb to thereby generate a spark of the flint 8. The ignition is completed. When the generated flame is unnecessary, the pressing force applied to the intermediate portion 10 is simply released to thereby cut the fuel feeding.

According to this embodiment, the operational clip 10 is made of flexible material and the sleeve portion 10*a* is slanted backwardly with the rasp wheel moved backwardly. Therefore, the distance between the injection tip 4*a* and the rasp wheel can be predeterminedly shortened in comparison with a conventional seesaw type operational member corresponding to the clip 10 of the first embodiment. As a result, according to the present invention, a slim cylindrical lighter like a pen can be readily obtained. In such a simplified type lighter, a fuel tank is filled with a fuel from the upper portion. In this case, according to the present invention, before the upper pipe 4A and the porous material 7 are inserted into the outer valve member, the outer valve member serves as a check valve during fuel supplying to the fuel tank. This makes assembly procedures and works easy.

FIGS. 6 and 7 show a second embodiment of a gas lighter according to the present invention. In the following embodiments, like members or parts will be used with the same reference numerals as used in FIGS. 1 to 5. Element 1 is a fuel tank which is made of a transparent material in order to readily observe a filled fuel therein. An outer valve member 2 is made of a softened flexible material and inserted into a hole of a disc member 1*a*. A fuel injection pipe 4 is implanted in the outer valve member 2 and has a small lateral hole 13 in a lower end portion thereof. In no-use state shown in FIG. 6, the lateral hole 13 is closed by an inner wall of the outer valve member 2. A sleeve 10*a* is rotatably supported by a shaft 9' secured to the disc member 1*a*. A rasp wheel 5 and a frictional wheel 5*a* are provided on the sleeve 10*a* and a flint 8 urged by a spring 6 is surrounded by the sleeve 10*a*. An arm plate 10*c* extends from an upper portion of the sleeve 10*a*. An adjusting knob 15 is loosely engaged with a longitudinal teeth formed on the fuel injection pipe 4. By the rotation of the knob 15, the fuel flow rate is adjusted. Element 7 is a porous material which serves to rectify the flow of the fuel gas and element 14 is a washer having a through-hole therein. Element 11 is a fuel supply pipe made of a flux of polyethylene fibers. Element 3 is a windbreak.

When the rasp wheel is pressed forwardly and rotated, the fuel injection pipe 4 is slanted by the pressing action of the arm plate 10*c*, and the outer valve member is deformed so as to produce a gap 16 between the lateral hole 13 and the outer valve member 2 and a continuous fuel passage to thereby complete the ignition.

An adjustment of the fuel flow rate is readily achieved by rotating the adjust knob 15 to direct the lateral hole 13 in the side direction. If the lateral hole 13 is directed backward, the fuel can be prevented to flow through the injection pipe 4. Therefore, if the injection pipe is turned to the backward, accidental fuel leakage can be prevented. This is suitable for carrying the lighter.

Also, according to this embodiment, a compact lighter is simple in construction. A fuel supply to the fuel tank of the lighter is readily achieved through a fuel injection pipe in the factory.

Figure 8:
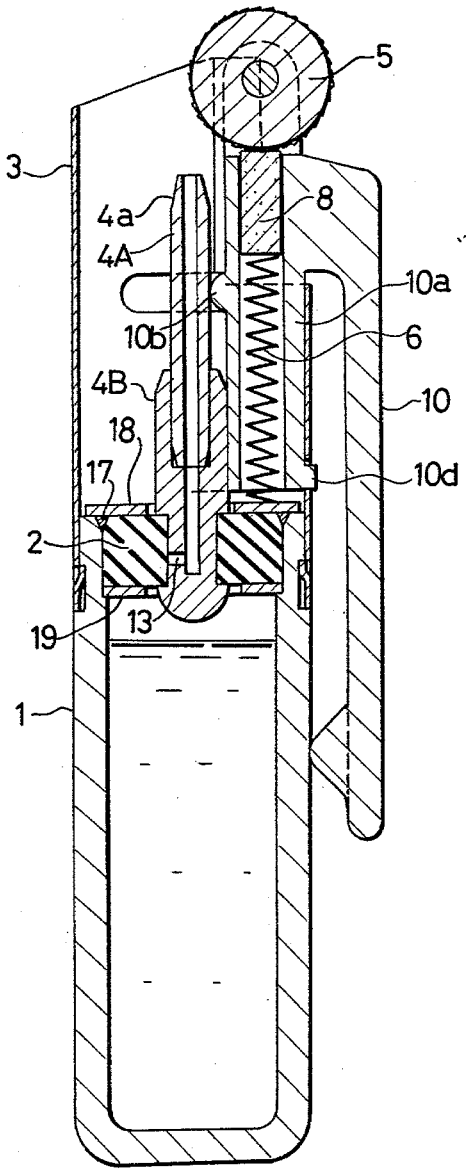
FIG. 8 is a cross sectional view showing a third embodiment of the gas lighter according to the present invention.
Figure 9:
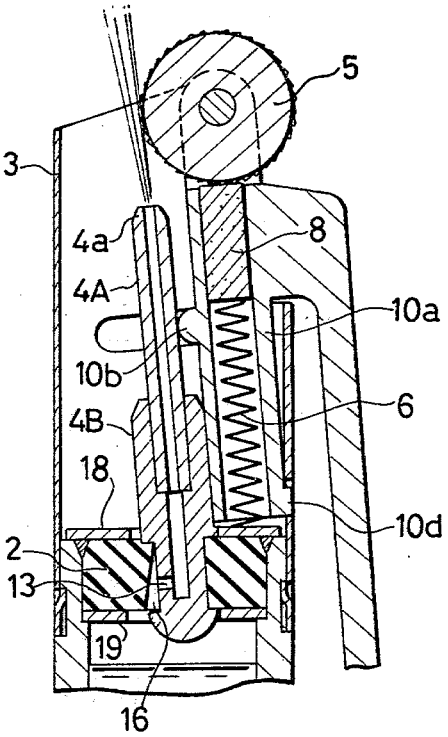
FIGS. 9 and 10 are cross sectional, in part, views showing other states of the gas lighter shown in FIG. 8.
Figure 10:
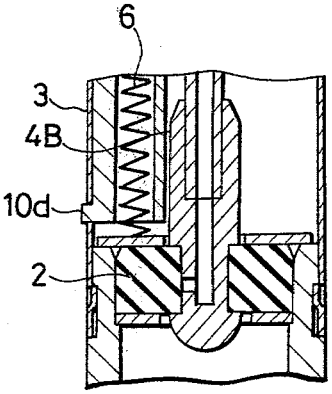

FIGS. 8 to 10 show a third embodiment of a gas lighter according to the present invention.

In this embodiment, an outer valve member 2 serves a multifunction member. That is, the outer valve member serves as a lid for a fuel tank 1, a fuel supply control valve and an adjusting member of a fuel flow rate. A cylindrical windbreak is rotatably secured to a fuel tank 1. A mutual relationship between a clip 10 and a fuel tank 1 is freely variable. An indication mark (not shown) is useful for indicating the positional relationship therebetween. A clip assembly consisting of a clip 10, a sleeve 10*a*, a rasp wheel, a spring 6 and a flint 8 is rotated together with windbreak 3. In contrast, a lower pipe 4B coupled to a fuel injection pipe 4A is implanted in the outer valve member 2 which is sandwiched by an outer protect disc 18 and a lower protect disc 19 each having a through-hole therein. The lower pipe 4B has a lateral hole 13 facing to the inner side wall of the outer valve member 2 and a flanged portion at the lower end thereof for sealing the fuel tank. The outer valve member is fixedly inserted into the fuel tank with an adhesive 17. A sleeve 10*a* has a projection 10*b*. The clip assembly is provided so that the vertically implanted and the fuel injection pipe 4 can be pressed in any direction. The sleeve 10*a* is supported by the windbreak 3 through a suitable support rod (not shown).

When the upper portion of the clip is pushed forwardly, the fuel injection pipe 4 is slanted and if the lateral hole is directed forwardly, a gap 16 is produced between the lateral hole and the outer valve member so that a fuel gas can be supplied therethrough to an injection tip 4*a*. In this state, the rasp wheel 5 is rotated to thereby generate a spark to complete the ignition. When the lateral hole is directed to the closed direction as shown in FIG. 10, the fuel is not supplied even if the upper portion of the clip is pushed inwardly.

In the preceding embodiments, at least one lateral hole is required in the fuel injection pipe. However, this is liable to incur a trouble because a metal tube is machined with high mechanical accuracy. In view of this, in the following embodiment, a formation of such a lateral small hole in the metallic pipe can be dispensed with. FIGS. 11 to 15 show a fourth embodiment of a gas lighter according to the present invention.

Element 1 is a fuel tank a configuration of which is cylindrical, in this embodiment. A top opening portion of the fuel tank is plugged by an outer valve member 2 with an adhesive 17 An upstanding fuel injection pipe 4 is sealingly inserted at its lower extremity into the upper bore formed in the outer valve member 2 and projects upwardly vertically therefrom. The hole 23 is blind at its bottom end but is in communication with an axially offset hole 24 which is blind at its top end and opens downwardly from the lower side of the outer valve member 2.

A flint retaining barrel member 22 is secured to a windbreak but slidable in the vertical direction. The windbreak 3' is in the form of a cylindrical shell open on one side and formed with internal confronting teeth 3*b'* (FIG. 14) engaged with a plurality of vertical grooves 22*a* (FIG. 13) formed in the flint retaining member 22

Figure 13:
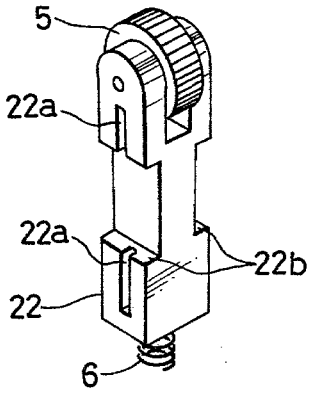
FIG. 13 is a perspective view showing a flint retaining member used in the gas lighter shown in FIG. 11.
Figure 14:
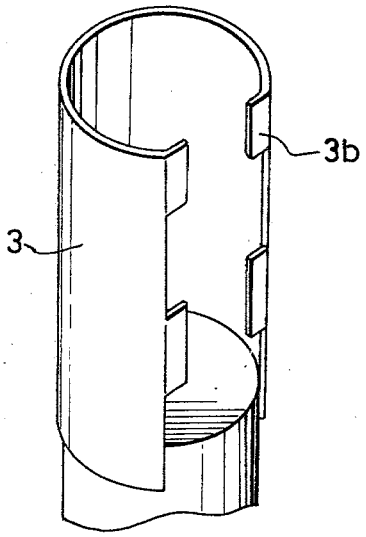
FIG. 14 is a perspective view showing a windbreak used in the gas lighter shown in FIG. 11.

(FIG. 13). The windbreak 3' is secured to the upper portion of the fuel tank 1. Received telescopically in the upper extremity of the bore of the barrel 22 is a cylindrical flint which is biased upwardly by means of a coil compression spring 6.

Figure 11:
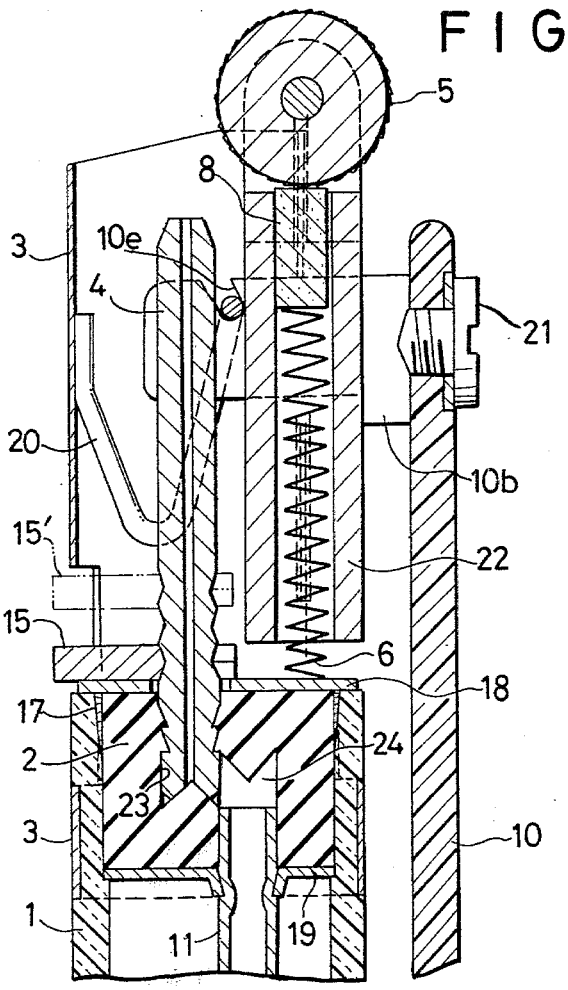
FIG. 11 is an enlarged cross sectional, in part, view showing a fourth embodiment of the gas lighter according to the present invention.
Figure 12:
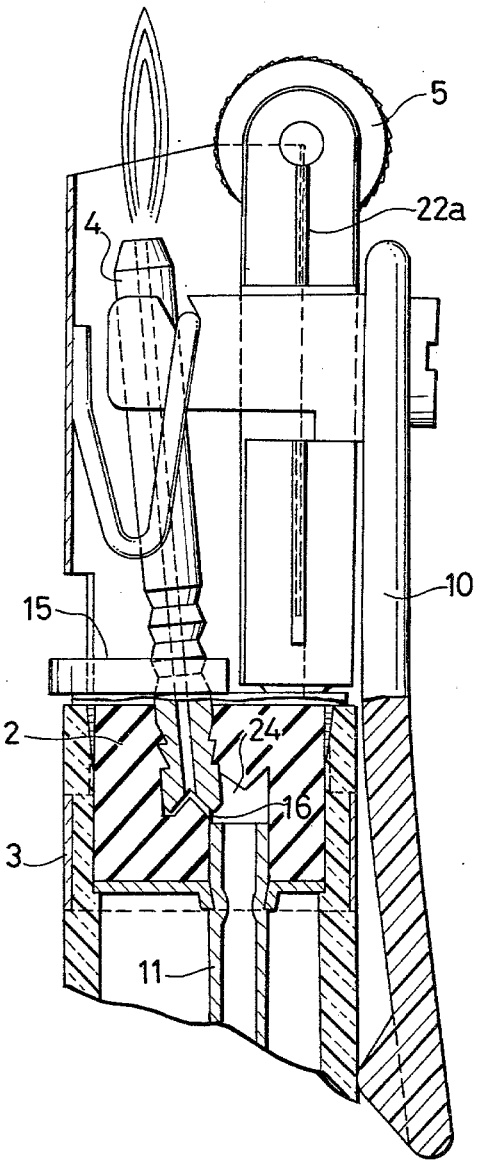
FIG. 12 is an enlarged cross sectional, in part, view showing another state of the gas lighter, in which a flame is produced, shown in FIG. 11.
Figure 15:
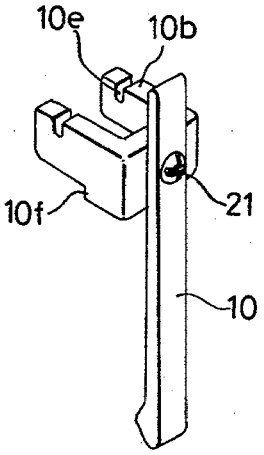
FIG. 15 is a perspective view showing a clip assembly used in the gas lighter shown in FIG. 11.

A clip assembly consists of a vertical clip rod 10 and a carriage formed with a pair of horizontal pusher arms 10*b* secured to the clip rod 10 by a screw 21 as best shown in FIG. 15. The clip terminates at its lower extremity in an inwardly projecting cam 10*g* which engages the body 1 of the lighter. A U-shaped spring member 20 secured on one side to the windbreak with a suitable adhesive or by welding and is engaged on its opposite side with grooves 10*e* formed in the arms 10*b* to thereby urge the clip assembly transversely outwardly in the windbreak 3'. In FIG. 11, transverse movement inwardly of the clip assembly is limited by engagement of the steps 10*f* (FIG. 15) with shouldered portions 22*b* of the flint retaining member. However, when the rasp wheel 5 is pushed down, the abutment between the stepped portions 10*f* and the shouldered portions 22*b* is released to thereby allow the arm 10*b* to move forwardly by the pushing operation of the clip rod 10. As a result, the fuel injection pipe 4 is slanted by the pushing force of the rod against the spring force due to the spring member 20. When the fuel injection pipe 4 is slanted, a gap 16 is produced to thereby supply the injection pipe with a fuel gas. A gas lighter according to this embodiment is easy to use in a natural gripping state of the operator's hand. In this embodiment, the small lateral hole is not used in the injection pipe and hence, there is no possibility of clogging.

A pipe slant stopper 15 serves as an adjustment fulcrum. When the stopper 15 is lifted at 15' as shown in FIG. 11, the slant degree becomes small to thereby reduce a flow rate of the fuel.

Figure 16:
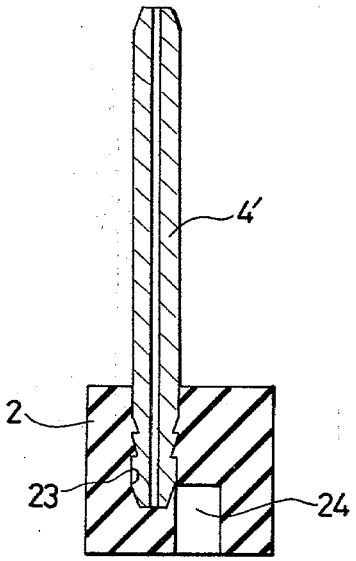
FIG. 16 is a modification of an outer valve member.

FIG. 16 shows a modification of holes 23 and 24 formed in the outer valve member 2. A lower end of a fuel injection pipe 4' is rounded. In no-use state, the fuel gas is prevented from flowing upward. Substantially the same effect can be obtained.

This invention has been explained with respect to the specific embodiments. However, it is apparent that various modifications to this invention can be made without departing from the scope thereof.

What is claimed is:

1. A pen-shaped gas lighter comprising:

a hollow elongated body formed with a fuel tank terminating at one end in an opening;

an igniter mounted on said body;

a resilient outer valve member received in said opening and formed with a first port leading from said tank;

a rigid standpipe mounted on one end in said outer valve member and terminating at its lower extremity in a second port normally out of communication with said first port and selectively communicatable with said first port upon said standpipe being shifted from its upright position to a predetermined angle, said standpipe terminating at its upper extremity in a burner nozzle disposed adjacent said igniter;

a clip carriage movably mounted on said body for movement from an inoperative to an operative position, said carriage including pusher means coupled with said standpipe for shifting of said standpipe to said predetermined angle upon shifting thereof to said operative position;

a resilient clip carried on one end from said carriage and projecting along said body to yieldingly engage said body on its opposite end for selective receipt between said second end and body of a piece of clothing, said clip being further formed to serve as a thumb holder for pressing thereof to said carriage to said operative position; and, biasing means connected with said standpipe for biasing said standpipe to said normal position whereby said clip may be utilized to clip said lighter to the pocket of a user's shirt for storage and when said lighter is to be used, it may be removed from said pocket and the user's thumb engaged with said clip to press said clip and shift said carriage to said operative portion to angle said standpipe to said predetermined angle and said igniter actuated to ignite fuel emitting from said burner nozzle.

2. A lighter as set forth in claim 1 that includes:

mounting means mounting said carriage from said body for relative longitudinal movement of said carriage relative to said body from a safety position to a release position; and, lock means operative when said carriage is in said safety position to lock said carriage in said inoperative position.

3. A lighter as set forth in claim 2 wherein:

said lock means includes a step carried by said clip carriage facing laterally inwardly, and further includes a shoulder carried from said body disposed in said path and facing laterally for engagement with said step to limit lateral inward shifting of said carriage, thus preventing tilting of said standpipe to said predetermined angle, said shoulder and step being selectively shiftable longitudinally relative to one another to shift said shoulder out of said path.

4. A lighter as set forth in claim 1 wherein:

said clip is spaced laterally outwardly from said body throughout its medial length and is formed on its free extremity with a laterally inwardly projecting cam engaged with the periphery of said body, said clip even further having sufficient resiliency to be bowed medially laterally inwardly toward said body to enable said carriage to be pushed laterally inwardly to said operative position.

5. A lighter as set forth in claim 1 wherein:

said standpipe is mounted and configured to be engaged by said carriage upon movement to said operative position to angle said nozzle away from said igniter to direct any flame from said burner nozzle away from said igniter.

6. A lighter as set forth in claim 2 that includes a windbreak surrounding said carriage and wherein:

said biasing means is in the form of a U-shaped spring mounted on one end from said windbreak and is arranged to urge said lock means into position locking said carriage in said inoperative position.

* * * * *

UNITED STATES PATENT AND TRADEMARK OFFICE

CERTIFICATE OF CORRECTION

PATENT NO. : 4,325,692

DATED : April 20, 1982

INVENTOR(S) : Seiichi Kitabayashi

It is certified that error appears in the above—identified patent and that said Letters Patent is hereby corrected as shown below:

Column 1, line 7, delete "use" and insert --used--;

Column 2, line 65, delete "compression degree of" and insert --degree of compression of--;

Column 4, line 64, after windbreak insert --3'--; and,

Column 6, line 21, delete "portion" and insert --position--.

Signed and Sealed this

*Twelfth* Day of *October 1982*

[SEAL]

*Attest:*

GERALD J. MOSSINGHOFF

*Attesting Officer*

*Commissioner of Patents and Trademarks*